US010885925B2

(12) United States Patent
Atti et al.

(10) Patent No.: US 10,885,925 B2
(45) **Date of Patent: *Jan. 5, 2021**

(54) HIGH-BAND RESIDUAL PREDICTION WITH TIME-DOMAIN INTER-CHANNEL BANDWIDTH EXTENSION

(71) Applicant: QUALCOMM Incorporated, San Diego, CA (US)

(72) Inventors: Venkatraman Atti, San Diego, CA (US); Venkata Subrahmanyam Chandra Sekhar Chebiyyam, Seattle, WA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/511,386

(22) Filed: Jul. 15, 2019

(65) Prior Publication Data

US 2019/0341063 A1 Nov. 7, 2019

Related U.S. Application Data

(63) Continuation of application No. 16/000,551, filed on Jun. 5, 2018, now Pat. No. 10,431,231.

(60) Provisional application No. 62/526,854, filed on Jun. 29, 2017.

(51) Int. Cl.

| | |
|---|---|
| ***G10L 19/03*** | (2013.01) |
| ***G10L 21/038*** | (2013.01) |
| ***G10L 19/008*** | (2013.01) |
| ***G10L 21/0388*** | (2013.01) |
| ***G10L 19/02*** | (2013.01) |

(52) U.S. Cl.
CPC ..... *G10L 19/03* (2013.01); *G10L 19/008* (2013.01); *G10L 21/038* (2013.01); *G10L 21/0388* (2013.01); *G10L 19/0204* (2013.01)

(58) Field of Classification Search
CPC ..... G10L 19/03; G10L 19/008; G10L 21/038; G10L 21/0388; G10L 19/0204
USPC ..... 704/500
See application file for complete search history.

(56) References Cited

U.S. PATENT DOCUMENTS

2008/0126082 A1* 5/2008 Ehara ..... G10L 19/24 704/205
2010/0106493 A1 4/2010 Zhou et al.
2013/0156112 A1 6/2013 Suzuki et al.
(Continued)

OTHER PUBLICATIONS

Bhatt N.S., et al., "Simulation and Overall Comparative Evaluation of Performance Between Different Techniques for High Band Feature Extraction Based on Artificial Bandwidth Extension of Speech Over Proposed Global System for Mobile Full Rate Narrow Band Coder", International Journal of Speech Technology, Kluwer, Dordrecht, NL, Oct. 8, 2016, vol. 19, No. 4, pp. 881-893, XP036093476, ISSN: 1381-2416, DOI:10.1007/S10772-016-9378-9 [retrieved on Oct. 8, 2016].

(Continued)

*Primary Examiner* — Quynh H Nguyen
(74) *Attorney, Agent, or Firm* — Moore IP

(57) ABSTRACT

A method includes processing a time-domain decoded high-band mid signal to generate a time-domain high-band residual prediction signal. The method also includes generating a high-band left channel and a high-band right channel based on the time-domain decoded high-band mid signal and the time-domain high-band residual prediction signal.

30 Claims, 6 Drawing Sheets

(56) References Cited

U.S. PATENT DOCUMENTS

| | | | | |
|---|---|---|---|---|
| 2015/0269948 | A1 | 9/2015 | Purnhagen et al. | |
| 2016/0275957 | A1 | 9/2016 | Dick et al. | |
| 2017/0365263 | A1* | 12/2017 | Disch | G10L 19/04 |
| 2018/0144751 | A1 | 5/2018 | Purnhagen et al. | |
| 2019/0005973 | A1 | 1/2019 | Atti et al. | |

OTHER PUBLICATIONS

International Search Report and Written Opinion—PCT/US2018/036253—ISA/EPO—dated Aug. 9, 2018.

* cited by examiner

HIGH-BAND RESIDUAL PREDICTION WITH TIME-DOMAIN INTER-CHANNEL BANDWIDTH EXTENSION

I. CROSS REFERENCE TO RELATED APPLICATIONS

The present application claims priority from and is a continuation application of U.S. patent application Ser. No. 16/000,551, filed Jun. 5, 2018 and entitled "HIGH-BAND RESIDUAL PREDICTION WITH TIME-DOMAIN INTER-CHANNEL BANDWIDTH EXTENSION," which claims priority from U.S. Provisional Patent Application No. 62/526,854, entitled "HIGH-BAND RESIDUAL PREDICTION WITH TIME-DOMAIN INTER-CHANNEL BANDWIDTH EXTENSION," filed Jun. 29, 2017, which is expressly incorporated by reference herein in its entirety.

II. FIELD

The present disclosure is generally related to encoding of multiple audio signals.

III. DESCRIPTION OF RELATED ART

Advances in technology have resulted in smaller and more powerful computing devices. For example, a variety of portable personal computing devices, including wireless telephones such as mobile and smart phones, tablets and laptop computers are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A computing device may include or may be coupled to multiple microphones to receive audio signals. Generally, a sound source is closer to a first microphone than to a second microphone of the multiple microphones. Accordingly, a second audio signal received from the second microphone may be delayed relative to a first audio signal received from the first microphone due to the respective distances of the microphones from the sound source. In other implementations, the first audio signal may be delayed with respect to the second audio signal. In stereo-encoding, audio signals from the microphones may be encoded to generate a mid signal and one or more side signals. The mid signal corresponds to a sum of the first audio signal and the second audio signal. A side signal corresponds to a difference between the first audio signal and the second audio signal.

IV. SUMMARY

In a particular implementation, a device includes a low-band mid signal decoder configured to decode a low-band portion of an encoded mid signal to generate a decoded low-band mid signal. The device also includes a low-band residual prediction unit configured to process the decoded low-band mid signal to generate a low-band residual prediction signal. The device further includes an up-mix processor configured to generate a low-band left channel and a low-band right channel based partially on the decoded low-band mid signal and the low-band residual prediction signal. The device also includes a high-band mid signal decoder configured to decode a high-band portion of the encoded mid signal to generate a time-domain decoded high-band mid signal. The device further includes a high-band residual prediction unit configured to process the time-domain decoded high-band mid signal to generate a time-domain high-band residual prediction signal. The device also includes an inter-channel bandwidth extension decoder configured to generate a high-band left channel and a high-band right channel based on the time-domain decoded high-band mid signal and the time-domain high-band residual prediction signal.

In another particular implementation, a method includes decoding a low-band portion of an encoded mid signal to generate a decoded low-band mid signal. The method also includes processing the decoded low-band mid signal to generate a low-band residual prediction signal and generating a low-band left channel and a low-band right channel based partially on the decoded low-band mid signal and the low-band residual prediction signal. The method further includes decoding a high-band portion of the encoded mid signal to generate a decoded high-band mid signal and processing the decoded high-band mid signal to generate a high-band residual prediction signal. The method also includes generating a high-band left channel and a high-band right channel based on the decoded high-band mid signal and the high-band residual prediction signal.

In another particular implementation, a non-transitory computer-readable medium includes instructions that, when executed by a processor within a decoder, cause the decoder to perform operations including decoding a low-band portion of an encoded mid signal to generate a decoded low-band mid signal. The operations also include processing the decoded low-band mid signal to generate a low-band residual prediction signal and generating a low-band left channel and a low-band right channel based partially on the decoded low-band mid signal and the low-band residual prediction signal. The operations also include decoding a high-band portion of the encoded mid signal to generate a decoded high-band mid signal and processing the decoded high-band mid signal to generate a high-band residual prediction signal. The operations also include generating a high-band left channel and a high-band right channel based on the decoded high-band mid signal and the high-band residual prediction signal.

In another particular implementation, a device includes means for decoding a low-band portion of an encoded mid signal to generate a decoded low-band mid signal. The device also includes means for processing the decoded low-band mid signal to generate a low-band residual prediction signal and means for generating a low-band left channel and a low-band right channel based partially on the decoded low-band mid signal and the low-band residual prediction signal. The device further includes means for decoding a high-band portion of the encoded mid signal to generate a decoded high-band mid signal and means for processing the decoded high-band mid signal to generate a high-band residual prediction signal. The device also includes means for generating a high-band left channel and a high-band right channel based on the decoded high-band mid signal and the high-band residual prediction signal.

Other implementations, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
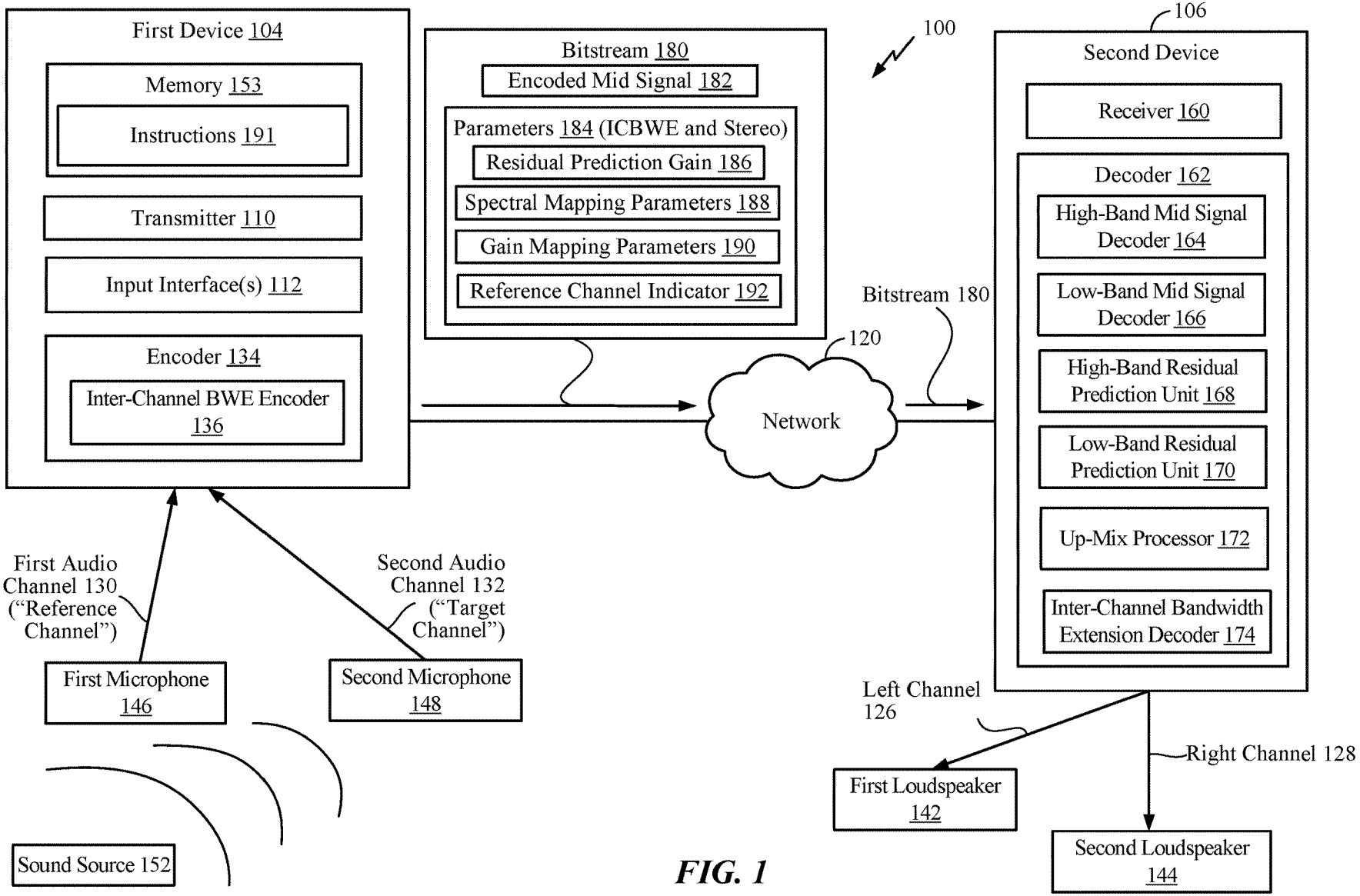
FIG. 1 is a block diagram of a particular illustrative example of a system that includes a decoder operable to predict a high-band residual channel and to perform time-domain interchannel bandwidth extension (ICBWE) decoding operations.

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprises" and "comprising" may be used interchangeably with "includes" or "including." Additionally, it will be understood that the term "wherein" may be used interchangeably with "where." As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining", "calculating", "shifting", "adjusting", etc. may be used to describe how one or more operations are performed. It should be noted that such terms are not to be construed as limiting and other techniques may be utilized to perform similar operations. Additionally, as referred to herein, "generating", "calculating", "using", "selecting", "accessing", and "determining" may be used interchangeably. For example, "generating", "calculating", or "determining" a parameter (or a signal) may refer to actively generating, calculating, or determining the parameter (or the signal) or may refer to using, selecting, or accessing the parameter (or signal) that is already generated, such as by another component or device.

Systems and devices operable to encode and decode multiple audio signals are disclosed. A device may include an encoder configured to encode the multiple audio signals. The multiple audio signals may be captured concurrently in time using multiple recording devices, e.g., multiple microphones. In some examples, the multiple audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

Audio capture devices in teleconference rooms (or telepresence rooms) may include multiple microphones that acquire spatial audio. The spatial audio may include speech as well as background audio that is encoded and transmitted. The speech/audio from a given source (e.g., a talker) may arrive at the multiple microphones at different times depending on how the microphones are arranged as well as where the source (e.g., the talker) is located with respect to the microphones and room dimensions. For example, a sound source (e.g., a talker) may be closer to a first microphone associated with the device than to a second microphone associated with the device. Thus, a sound emitted from the sound source may reach the first microphone earlier in time than the second microphone. The device may receive a first audio signal via the first microphone and may receive a second audio signal via the second microphone.

Mid-side (MS) coding and parametric stereo (PS) coding are stereo coding techniques that may provide improved efficiency over the dual-mono coding techniques. In dual-mono coding, the Left (L) channel (or signal) and the Right (R) channel (or signal) are independently coded without making use of inter-channel correlation. MS coding reduces the redundancy between a correlated L/R channel-pair by transforming the Left channel and the Right channel to a sum-channel and a difference-channel (e.g., a side signal) prior to coding. The sum signal (also referred to as the mid signal) and the difference signal (also referred to as the side signal) are waveform coded or coded based on a model in MS coding. Relatively more bits are spent on the mid signal than on the side signal. PS coding reduces redundancy in each sub-band by transforming the L/R signals into a sum signal (or mid signal) and a set of side parameters. The side parameters may indicate an inter-channel intensity difference (IID), an inter-channel phase difference (IPD), an inter-channel time difference (ITD), side or residual prediction gains, etc. The sum signal is waveform coded and transmitted along with the side parameters. In a hybrid system, the side-signal may be waveform coded in the lower bands (e.g., less than 2 kilohertz (kHz)) and PS coded in the upper bands (e.g., greater than or equal to 2 kHz) where the inter-channel phase preservation is perceptually less critical. In some implementations, the PS coding may be used in the lower bands also to reduce the inter-channel redundancy before waveform coding.

The MS coding and the PS coding may be done in either the frequency-domain or in the sub-band domain. In some examples, the Left channel and the Right channel may be uncorrelated. For example, the Left channel and the Right channel may include uncorrelated synthetic signals. When the Left channel and the Right channel are uncorrelated, the coding efficiency of the MS coding, the PS coding, or both, may approach the coding efficiency of the dual-mono coding.

Depending on a recording configuration, there may be a temporal shift between a Left channel and a Right channel, as well as other spatial effects such as echo and room reverberation. If the temporal shift and phase mismatch between the channels are not compensated, the sum channel and the difference channel may contain comparable energies reducing the coding-gains associated with MS or PS techniques. The reduction in the coding-gains may be based on the amount of temporal (or phase) shift. The comparable energies of the sum signal and the difference signal may limit the usage of MS coding in certain frames where the channels are temporally shifted but are highly correlated. In stereo coding, a Mid signal (e.g., a sum channel) and a Side signal (e.g., a difference channel) may be generated based on the following Formula:

$$M=(L+R)/2, S=(L-R)/2, \quad \text{Formula 1}$$

where M corresponds to the Mid signal, S corresponds to the Side signal, L corresponds to the Left channel, and R corresponds to the Right channel.

In some cases, the Mid signal and the Side signal may be generated based on the following Formula:

$$M=c(L+R), S=c(L-R), \quad \text{Formula 2}$$

where c corresponds to a complex value which is frequency dependent. Generating the Mid signal and the Side signal based on Formula 1 or Formula 2 may be referred to as "downmixing". A reverse process of generating the Left channel and the Right channel from the Mid signal and the Side signal based on Formula 1 or Formula 2 may be referred to as "upmixing".

In some cases, the Mid signal may be based other formulas such as:

$$M=(L+g_D R)/2, \text{ or} \quad \text{Formula 3}$$

$$M=g_1 L+g_2 R \quad \text{Formula 4}$$

where $g_1+g_2=1.0$, and where $g_D$ is a gain parameter. In other examples, the downmix may be performed in bands, where $mid(b)=c_1L(b)+c_2R(b)$, where $c_1$ and $c_2$ are complex numbers, where $side(b)=c_3L(b)-c_4R(b)$, and where $c_3$ and $c_4$ are complex numbers.

An ad-hoc approach used to choose between MS coding or dual-mono coding for a particular frame may include generating a mid signal and a side signal, calculating energies of the mid signal and the side signal, and determining whether to perform MS coding based on the energies. For example, MS coding may be performed in response to determining that the ratio of energies of the side signal and the mid signal is less than a threshold. To illustrate, if a Right channel is shifted by at least a first time (e.g., about 0.001 seconds or 48 samples at 48 kHz), a first energy of the mid signal (corresponding to a sum of the left signal and the right signal) may be comparable to a second energy of the side signal (corresponding to a difference between the left signal and the right signal) for voiced speech frames. When the first energy is comparable to the second energy, a higher number of bits may be used to encode the Side signal, thereby reducing coding efficiency of MS coding relative to dual-mono coding. Dual-mono coding may thus be used when the first energy is comparable to the second energy (e.g., when the ratio of the first energy and the second energy is greater than or equal to the threshold). In an alternative approach, the decision between MS coding and dual-mono coding for a particular frame may be made based on a comparison of a threshold and normalized cross-correlation values of the Left channel and the Right channel.

In some examples, the encoder may determine a mismatch value indicative of an amount of temporal misalignment between the first audio signal and the second audio signal. As used herein, a "temporal shift value", a "shift value", and a "mismatch value" may be used interchangeably. For example, the encoder may determine a temporal shift value indicative of a shift (e.g., the temporal mismatch) of the first audio signal relative to the second audio signal. The temporal mismatch value may correspond to an amount of temporal delay between receipt of the first audio signal at the first microphone and receipt of the second audio signal at the second microphone. Furthermore, the encoder may determine the temporal mismatch value on a frame-by-frame basis, e.g., based on each 20 milliseconds (ms) speech/audio frame. For example, the temporal mismatch value may correspond to an amount of time that a second frame of the second audio signal is delayed with respect to a first frame of the first audio signal. Alternatively, the temporal mismatch value may correspond to an amount of time that the first frame of the first audio signal is delayed with respect to the second frame of the second audio signal.

When the sound source is closer to the first microphone than to the second microphone, frames of the second audio signal may be delayed relative to frames of the first audio signal. In this case, the first audio signal may be referred to as the "reference audio signal" or "reference channel" and the delayed second audio signal may be referred to as the "target audio signal" or "target channel". Alternatively, when the sound source is closer to the second microphone than to the first microphone, frames of the first audio signal may be delayed relative to frames of the second audio signal. In this case, the second audio signal may be referred to as the reference audio signal or reference channel and the delayed first audio signal may be referred to as the target audio signal or target channel.

Depending on where the sound sources (e.g., talkers) are located in a conference or telepresence room or how the sound source (e.g., talker) position changes relative to the microphones, the reference channel and the target channel may change from one frame to another; similarly, the temporal delay value may also change from one frame to another. However, in some implementations, the temporal mismatch value may always be positive to indicate an amount of delay of the "target" channel relative to the "reference" channel. Furthermore, the temporal mismatch value may correspond to a "non-causal shift" value by which the delayed target channel is "pulled back" in time such that the target channel is aligned (e.g., maximally aligned) with the "reference" channel. The downmix algorithm to determine the mid signal and the side signal may be performed on the reference channel and the non-causal shifted target channel.

The encoder may determine the temporal mismatch value based on the reference audio channel and a plurality of temporal mismatch values applied to the target audio channel. For example, a first frame of the reference audio channel, X, may be received at a first time ($m_1$). A first particular frame of the target audio channel, Y, may be received at a second time ($n_1$) corresponding to a first temporal mismatch value, e.g., $shift1=n_1-m_1$. Further, a second frame of the reference audio channel may be received at a third time ($m_2$). A second particular frame of the target audio channel may be received at a fourth time ($n_2$) corresponding to a second temporal mismatch value, e.g., $shift2=n_2-m_2$.

The device may perform a framing or a buffering algorithm to generate a frame (e.g., 20 ms samples) at a first sampling rate (e.g., 32 kHz sampling rate (i.e., 640 samples per frame)). The encoder may, in response to determining that a first frame of the first audio signal and a second frame of the second audio signal arrive at the same time at the device, estimate a temporal mismatch value (e.g., shift1) as equal to zero samples. A Left channel (e.g., corresponding to the first audio signal) and a Right channel (e.g., corresponding to the second audio signal) may be temporally aligned.

In some cases, the Left channel and the Right channel, even when aligned, may differ in energy due to various reasons (e.g., microphone calibration).

In some examples, the Left channel and the Right channel may be temporally misaligned due to various reasons (e.g., a sound source, such as a talker, may be closer to one of the microphones than another and the two microphones may be greater than a threshold (e.g., 1-20 centimeters) distance apart). A location of the sound source relative to the microphones may introduce different delays in the Left channel and the Right channel. In addition, there may be a gain difference, an energy difference, or a level difference between the Left channel and the Right channel.

In some examples, where there are more than two channels, a reference channel is initially selected based on the levels or energies of the channels, and subsequently refined based on the temporal mismatch values between different pairs of the channels, e.g., t1(ref, ch2), t2(ref, ch3), t3(ref, ch4), . . . t3(ref, chN), where ch1 is the ref channel initially and t1(.), t2(.), etc. are the functions to estimate the mismatch values. If all temporal mismatch values are positive then ch1 is treated as the reference channel. If any of the mismatch values is a negative value, then the reference channel is reconfigured to the channel that was associated with a mismatch value that resulted in a negative value and the above process is continued until the best selection (e.g., based on maximally decorrelating maximum number of side signals) of the reference channel is achieved. A hysteresis may be used to overcome any sudden variations in reference channel selection.

In some examples, a time of arrival of audio signals at the microphones from multiple sound sources (e.g., talkers) may vary when the multiple talkers are alternatively talking (e.g., without overlap). In such a case, the encoder may dynamically adjust a temporal mismatch value based on the talker to identify the reference channel. In some other examples, the multiple talkers may be talking at the same time, which may result in varying temporal mismatch values depending on who is the loudest talker, closest to the microphone, etc. In such a case, identification of reference and target channels may be based on the varying temporal shift values in the current frame and the estimated temporal mismatch values in the previous frames, and based on the energy or temporal evolution of the first and second audio signals.

In some examples, the first audio signal and second audio signal may be synthesized or artificially generated when the two signals potentially show less (e.g., no) correlation. It should be understood that the examples described herein are illustrative and may be instructive in determining a relationship between the first audio signal and the second audio signal in similar or different situations.

The encoder may generate comparison values (e.g., difference values or cross-correlation values) based on a comparison of a first frame of the first audio signal and a plurality of frames of the second audio signal. Each frame of the plurality of frames may correspond to a particular temporal mismatch value. The encoder may generate a first estimated temporal mismatch value based on the comparison values. For example, the first estimated temporal mismatch value may correspond to a comparison value indicating a higher temporal-similarity (or lower difference) between the first frame of the first audio signal and a corresponding first frame of the second audio signal.

The encoder may determine a final temporal mismatch value by refining, in multiple stages, a series of estimated temporal mismatch values. For example, the encoder may first estimate a "tentative" temporal mismatch value based on comparison values generated from stereo pre-processed and re-sampled versions of the first audio signal and the second audio signal. The encoder may generate interpolated comparison values associated with temporal mismatch values proximate to the estimated "tentative" temporal mismatch value. The encoder may determine a second estimated "interpolated" temporal mismatch value based on the interpolated comparison values. For example, the second estimated "interpolated" temporal mismatch value may correspond to a particular interpolated comparison value that indicates a higher temporal-similarity (or lower difference) than the remaining interpolated comparison values and the first estimated "tentative" temporal mismatch value. If the second estimated "interpolated" temporal mismatch value of the current frame (e.g., the first frame of the first audio signal) is different than a final temporal mismatch value of a previous frame (e.g., a frame of the first audio signal that precedes the first frame), then the "interpolated" temporal mismatch value of the current frame is further "amended" to improve the temporal-similarity between the first audio signal and the shifted second audio signal. In particular, a third estimated "amended" temporal mismatch value may correspond to a more accurate measure of temporal-similarity by searching around the second estimated "interpolated" temporal mismatch value of the current frame and the final estimated temporal mismatch value of the previous frame. The third estimated "amended" temporal mismatch value is further conditioned to estimate the final temporal mismatch value by limiting any spurious changes in the temporal mismatch value between frames and further controlled to not switch from a negative temporal mismatch value to a positive temporal mismatch value (or vice versa) in two successive (or consecutive) frames as described herein.

In some examples, the encoder may refrain from switching between a positive temporal mismatch value and a negative temporal mismatch value or vice-versa in consecutive frames or in adjacent frames. For example, the encoder may set the final temporal mismatch value to a particular value (e.g., 0) indicating no temporal-shift based on the estimated "interpolated" or "amended" temporal mismatch value of the first frame and a corresponding estimated "interpolated" or "amended" or final temporal mismatch value in a particular frame that precedes the first frame. To illustrate, the encoder may set the final temporal mismatch value of the current frame (e.g., the first frame) to indicate no temporal-shift, i.e., shift1=0, in response to determining that one of the estimated "tentative" or "interpolated" or "amended" temporal mismatch value of the current frame is positive and the other of the estimated "tentative" or "interpolated" or "amended" or "final" estimated temporal mismatch value of the previous frame (e.g., the frame preceding the first frame) is negative. Alternatively, the encoder may also set the final temporal mismatch value of the current frame (e.g., the first frame) to indicate no temporal-shift, i.e., shift1=0, in response to determining that one of the estimated "tentative" or "interpolated" or "amended" temporal mismatch value of the current frame is negative and the other of the estimated "tentative" or "interpolated" or "amended" or "final" estimated temporal mismatch value of the previous frame (e.g., the frame preceding the first frame) is positive.

The encoder may select a frame of the first audio signal or the second audio signal as a "reference" or "target" based on the temporal mismatch value. For example, in response to determining that the final temporal mismatch value is positive, the encoder may generate a reference channel or signal indicator having a first value (e.g., 0) indicating that the first audio signal is a "reference" signal and that the second audio signal is the "target" signal. Alternatively, in response to determining that the final temporal mismatch value is negative, the encoder may generate the reference channel or signal indicator having a second value (e.g., 1) indicating that the second audio signal is the "reference" signal and that the first audio signal is the "target" signal.

The encoder may estimate a relative gain (e.g., a relative gain parameter) associated with the reference signal and the non-causal shifted target signal. For example, in response to determining that the final temporal mismatch value is positive, the encoder may estimate a gain value to normalize or equalize the amplitude or power levels of the first audio signal relative to the second audio signal that is offset by the non-causal temporal mismatch value (e.g., an absolute value of the final temporal mismatch value). Alternatively, in response to determining that the final temporal mismatch value is negative, the encoder may estimate a gain value to normalize or equalize the power or amplitude levels of the non-causal shifted first audio signal relative to the second audio signal. In some examples, the encoder may estimate a gain value to normalize or equalize the amplitude or power levels of the "reference" signal relative to the non-causal shifted "target" signal. In other examples, the encoder may estimate the gain value (e.g., a relative gain value) based on the reference signal relative to the target signal (e.g., the unshifted target signal).

The encoder may generate at least one encoded signal (e.g., a mid signal, a side signal, or both) based on the reference signal, the target signal, the non-causal temporal mismatch value, and the relative gain parameter. In other implementations, the encoder may generate at least one encoded signal (e.g., a mid signal, a side signal, or both) based on the reference channel and the temporal-mismatch adjusted target channel. The side signal may correspond to a difference between first samples of the first frame of the first audio signal and selected samples of a selected frame of the second audio signal. The encoder may select the selected frame based on the final temporal mismatch value. Fewer bits may be used to encode the side signal because of reduced difference between the first samples and the selected samples as compared to other samples of the second audio signal that correspond to a frame of the second audio signal that is received by the device at the same time as the first frame. A transmitter of the device may transmit the at least one encoded signal, the non-causal temporal mismatch value, the relative gain parameter, the reference channel or signal indicator, or a combination thereof.

The encoder may generate at least one encoded signal (e.g., a mid signal, a side signal, or both) based on the reference signal, the target signal, the non-causal temporal mismatch value, the relative gain parameter, low band parameters of a particular frame of the first audio signal, high band parameters of the particular frame, or a combination thereof. The particular frame may precede the first frame. Certain low band parameters, high band parameters, or a combination thereof, from one or more preceding frames may be used to encode a mid signal, a side signal, or both, of the first frame. Encoding the mid signal, the side signal, or both, based on the low band parameters, the high band parameters, or a combination thereof, may improve estimates of the non-causal temporal mismatch value and inter-channel relative gain parameter. The low band parameters, the high band parameters, or a combination thereof, may include a pitch parameter, a voicing parameter, a coder type parameter, a low-band energy parameter, a high-band energy parameter, an envelope parameter (e.g., a tilt parameter), a pitch gain parameter, a FCB gain parameter, a coding mode parameter, a voice activity parameter, a noise estimate parameter, a signal-to-noise ratio parameter, a formants parameter, a speech/music decision parameter, the non-causal shift, the inter-channel gain parameter, or a combination thereof. A transmitter of the device may transmit the at least one encoded signal, the non-causal temporal mismatch value, the relative gain parameter, the reference channel (or signal) indicator, or a combination thereof. In the present disclosure, terms such as "determining", "calculating", "shifting", "adjusting", etc. may be used to describe how one or more operations are performed. It should be noted that such terms are not to be construed as limiting and other techniques may be utilized to perform similar operations.

Referring to FIG. 1, a particular illustrative example of a system is disclosed and generally designated 100. The system 100 includes a first device 104 communicatively coupled, via a network 120, to a second device 106. The network 120 may include one or more wireless networks, one or more wired networks, or a combination thereof.

The first device 104 includes a memory 153, an encoder 134, a transmitter 110, and one or more input interfaces 112. The memory 153 includes a non-transitory computer-readable medium that includes instructions 191. The instructions 191 are executable by the encoder 134 to perform one or more of the operations described herein. A first input interface of the input interfaces 112 may be coupled to a first microphone 146. A second input interface of the input interface 112 may be coupled to a second microphone 148. The encoder 134 may include an inter-channel bandwidth extension (ICBWE) encoder 136. The ICBWE encoder 136 may be configured to estimate one or more spectral mapping parameters based on a synthesized non-reference high-band and a non-reference target channel. For example, the ICBWE encoder 136 may estimate spectral mapping parameters 188 and gain mapping parameters 190. The spectral mapping parameters 188 and the gain mapping parameters 190 may be referred to as "ICBWE parameters". However, for ease of description, the ICBWE parameters may also be referred to as "parameters".

The second device 106 includes a receiver 160 and a decoder 162. The decoder 162 may include a high-band mid signal decoder 164, a low-band mid signal decoder 166, a high-band residual prediction unit 168, a low-band residual prediction unit 170, an up-mix processor 172, and an ICBWE decoder 174. The decoder 162 may also include one or more other components that are not illustrated in FIG. 1. For example, the decoder 162 may include one or more transform units that are configured to transform a time-domain channel (e.g., a time-domain signal) into a frequency domain (e.g., a transform domain). Additional details associated with the operations of the decoder 162 are described with respect to FIGS. 2 and 3.

The second device 106 may be coupled to a first loudspeaker 142, a second loudspeaker 144, or both. Although not shown, the second device 106 may include other components, such a processor (e.g., central processing unit), a microphone, a transmitter, an antenna, a memory, etc.

During operation, the first device 104 may receive a first audio channel 130 (e.g., a first audio signal) via the first input interface from the first microphone 146 and may receive a second audio channel 132 (e.g., a second audio signal) via the second input interface from the second microphone 148. The first audio channel 130 may correspond to one of a right channel or a left channel. The second audio channel 132 may correspond to the other of the right channel or the left channel. A sound source 152 (e.g., a user, a speaker, ambient noise, a musical instrument, etc.) may be closer to the first microphone 146 than to the second microphone 148. Accordingly, an audio signal from the sound source 152 may be received at the input interfaces 112 via the first microphone 146 at an earlier time than via the second microphone 148. This natural delay in the multi-channel signal acquisition through the multiple microphones may introduce a temporal misalignment between the first audio channel 130 and the second audio channel 132.

According to one implementation, the first audio channel 130 may be a "reference channel" and the second audio channel 132 may be a "target channel". The target channel may be adjusted (e.g., temporally shifted) to substantially align with the reference channel. According to another implementation, the second audio channel 132 may be the reference channel and the first audio channel 130 may be the target channel. According to one implementation, the reference channel and the target channel may vary on a frame-to-frame basis. For example, for a first frame, the first audio channel 130 may be the reference channel and the second audio channel 132 may be the target channel. However, for a second frame (e.g., a subsequent frame), the first audio channel 130 may be the target channel and the second audio channel 132 may be the reference channel. For ease of description, unless otherwise noted below, the first audio channel 130 is the reference channel and the second audio channel 132 is the target channel. It should be noted that the reference channel described with respect to the audio channels 130, 132 may be independent from a reference channel indicator 192 (e.g., a high-band reference channel indicator). For example, the reference channel indicator 192 may indicate that a high-band of either channel 130, 132 is the high-band reference channel, and the reference channel indicator 192 may indicate a high-band reference channel which could be either the same channel or a different channel from the reference channel.

The encoder 134 may generate a mid signal, a side signal, or both, based on the first audio channel 130 and the second audio channel 132 using the above-described techniques with respect Formulas 1-4. The encoder 134 may encode the mid signal to generate the encoded mid signal 182. The encoder 134 may also generate parameters 184 (e.g., ICBWE parameters, stereo parameters, or both). For example, the encoder 134 may generate a residual prediction gain 186 (e.g., a side signal gain) and the reference channel indicator 192. The reference channel indicator 192 may indicate, on a frame-by-frame basis, whether the reference channel is the left channel or the right channel. The ICBWE encoder 136 may generate spectral mapping parameters 188 and gain mapping parameters 190. The spectral mapping parameters 188 map the spectrum (or energies) of a non-reference high-band channel to the spectrum of a synthesized non-reference high-band channel. The gain mapping parameters 190 may map the gain of the non-reference high-band channel to the gain of the synthesized non-reference high-band channel.

The transmitter 110 may transmit the bitstream 180, via the network 120, to the second device 106. The bitstream 180 includes at least the encoded mid signal 182 and the parameters 184. According to other implementations, the bitstream 180 may include additional encoded channels (e.g., an encoded side signal) and additional stereo parameters (e.g., interchannel intensity difference (IID) parameters, interchannel level differences (ILD) parameters, interchannel time difference (ITD) parameters, interchannel phase difference (IPD) parameters, inter-channel voicing parameters, inter-channel pitch parameters, inter-channel gain parameters, etc.).

The receiver 160 of the second device 106 may receive the bitstream 180, and the decoder 162 decodes the bitstream 180 to generate a first channel (e.g., a left channel 126) and a second channel (e.g., a right channel 128). The second device 106 may output the left channel 126 via the first loudspeaker 142 and may output the right channel 128 via the second loudspeaker 144. In alternative examples, the left channel 126 and right channel 128 may be transmitted as a stereo signal pair to a single output loudspeaker. Operations of the decoder 162 are described in further detail with respect to FIGS. 2-3.

Figure 2:
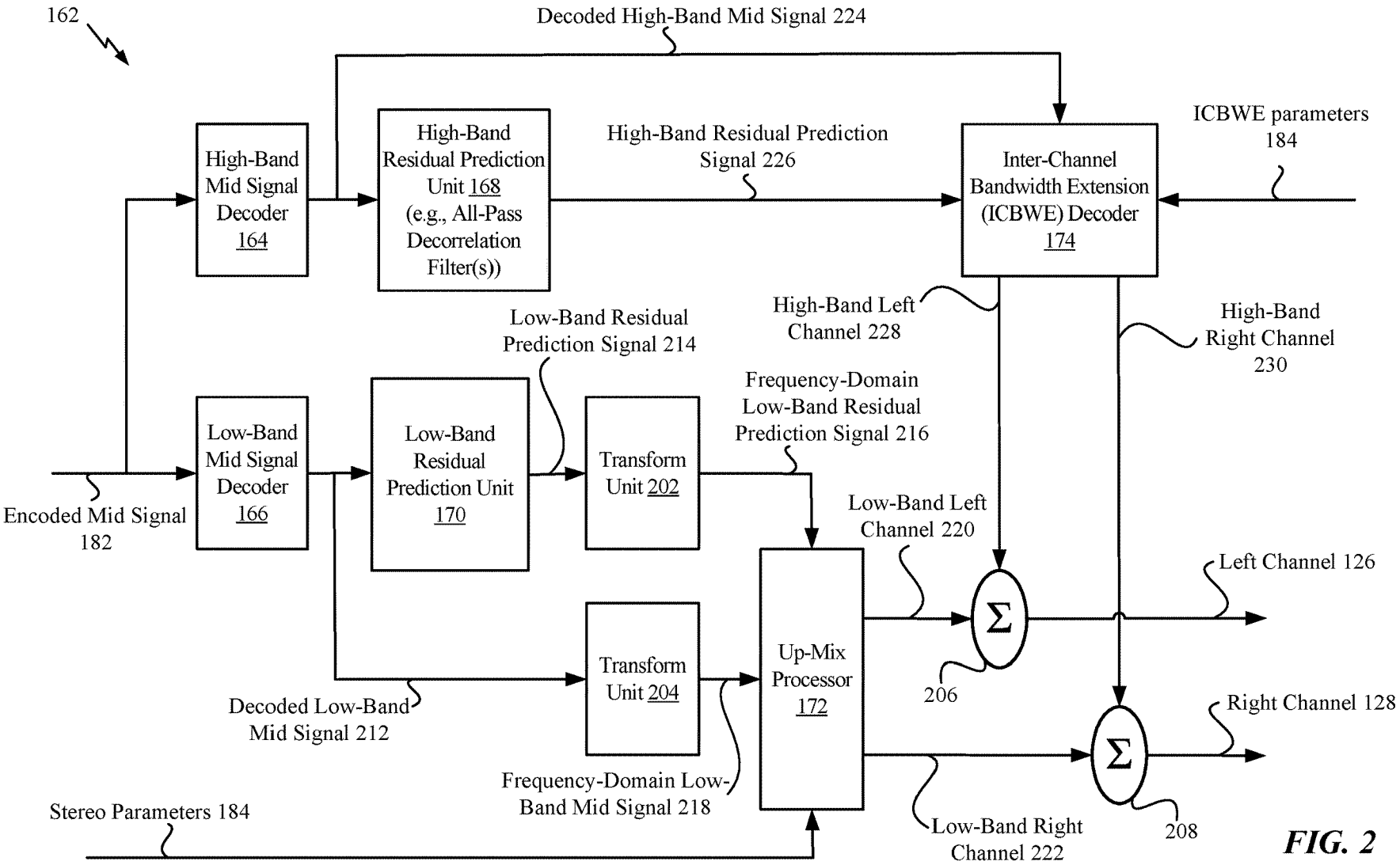
FIG. 2 is a diagram illustrating the decoder of FIG. 1.

Referring to FIG. 2, a particular implementation of the decoder 162 is shown. The decoder 162 includes the high-band mid signal decoder 164, the low-band mid signal decoder 166, the high-band residual prediction unit 168, the low-band residual prediction unit 170, the up-mix processor 172, the ICBWE decoder 174, a transform unit 202, a transform unit 204, a combination circuit 206, and a combination circuit 208.

The encoded mid signal 182 is provided to the high-band mid signal decoder 164 and to the low-band mid signal decoder 166. The low-band mid signal decoder 166 may be configured to decode a low-band portion of the encoded mid signal 182 to generate a decoded low-band mid signal 212. As a non-limiting example, if the encoded mid signal 182 is a Super Wideband signal having audio content between 50 Hz and 16 kHz, the low-band portion of the encoded mid signal 182 may span from 50 Hz to 8 kHz, and a high-band portion of the encoded mid signal 182 may span from 8 kHz to 16 kHz. The low-band mid signal decoder 166 may decode the low-band portion (e.g., the portion between 50 Hz and 8 kHz) of the encoded mid signal 182 to generate the decoded low-band mid signal 212. It should be understood that the above example is for illustrative purposes only and should not be construed as limiting. In other examples, the encoded mid signal 182 may be a Wideband signal, a Full-Band signal, etc. The decoded low-band mid signal 212 (e.g., a time-domain channel) is provided to the low-band residual prediction unit 170 and to a transform unit 204.

The low-band residual prediction unit 170 may be configured to process the decoded low-band mid signal 212 to generate a low-band residual prediction signal 214 (e.g., a low-band stereo filling channel or a predicted low-band side signal). The "process" may include filtering operations, non-linear processing operations, phase modification operations, resampling operations, or scaling operations. For example, the low-band residual prediction unit 170 may include one or more all-pass decorrelation filters. The low-band residual prediction unit 170 may apply the all-pass decorrelation filters to the decoded low-band mid signal 212 (e.g., at 16 kHz bandwidth signal) to generate (or "predict") the low-band residual prediction signal 214. The low-band residual prediction signal 214 is provided to the transform unit 202.

The transform unit 202 may be configured to perform a transform operation on the low-band residual prediction signal 214 to generate a frequency-domain low-band residual prediction signal 216. It should be noted that prior to the transform operation, in some implementations, a windowing operation is also performed which is not shown in the FIG. 2. The transform unit 202 may perform a Discrete Fourier Transform (DFT) analysis on the low-band residual prediction signal 214 to generate the frequency-domain low-band residual prediction signal 216. The frequency-domain low-band residual prediction signal 216 is provided to the up-mix processor 172. The transform unit 204 may be configured to perform a transform operation on the decoded low-band mid signal 212 to generate a frequency-domain low-band mid signal 218. For example, the transform unit 204 may perform a DFT analysis on the decoded low-band mid signal 212 to generate the frequency-domain low-band mid signal 218. The frequency-domain low-band mid signal 218 is provided to the up-mix processor 172.

The up-mix processor 172 may be configured to generate a low-band left channel 220 and a low-band right channel 222 based on the frequency-domain low-band residual prediction signal 216, the frequency-domain low-band mid signal 218, and one or more parameters 184 received from the first device 104. For example, the up-mix processor 172 may perform an up-mix operation on the frequency-domain low-band mid signal 218 and the frequency-domain low-band residual prediction signal (e.g., a predicted frequency-domain low-band side signal) to generate the low-band left channel 220 and the low-band right channel 222. The stereo parameters 184 may be used during the up-mix operation. For example, the up-mix processor 172 may apply the IID parameters, the ILD parameters, the ITD parameters, the IPD parameters, the inter-channel voicing parameters, the inter-channel pitch parameters, and the inter-channel gain parameters during the up-mix operation. Additionally, the up-mix processor 172 may apply the residual prediction gains 186 to the frequency-domain low-band residual prediction signal in frequency bands to determine the side signal at the decoder 162. The up-mix processor 172 may use the reference channel indicator 192 to designate the low-band left channel 220 and the low-band right channel 222. For example, the reference channel indicator 192 may indicate whether a low-band reference channel generated by the up-mix processor 172 corresponds to the low-band left channel 220 or the low-band right channel 222. The low-band left channel 220 is provided to the combination circuit 206, and the low-band right channel 222 is provided to the combination circuit 208. According to some implementations, the up-mix processor 172 includes inverse transform units (not shown) that are configured to perform transform operations on the low-band reference channel and a low-band target channel to generate the channels 220, 222. For example, the inverse transform units may apply inverse DFT operations on the low-band reference and target channels to generate the time-domain channels 220, 222.

The high-band mid signal decoder 164 may be configured to decode the high-band portion of the encoded mid signal 182 to generate a decoded high-band mid signal 224. As a non-limiting example, if the encoded mid signal 182 is a Super Wideband signal having audio content between 50 Hz and 16 kHz, the high-band portion of the encoded mid signal 182 may span from 8 kHz to 16 kHz. The high-band mid signal decoder 166 may decode the high-band portion of the encoded mid signal 182 to generate the decoded high-band mid signal 224. The decoded high-band mid signal 224 (e.g., a time-domain channel) is provided to the high-band residual prediction unit 168 and to the ICBWE decoder 174.

The high-band residual prediction unit 168 may be configured to process the decoded high-band mid signal 224 to generate a high-band residual prediction signal 226 (e.g., a high-band stereo filling channel or a predicted high-band side signal). For example, the high-band residual prediction unit 168 may include one or more all-pass decorrelation filters. The high-band residual prediction unit 168 may apply the all-pass decorrelation filters to the decoded high-band mid signal 224 (e.g., a 16 kHz bandwidth signal) to generate (or "predict") the high-band residual prediction signal 226. The high-band residual prediction signal 226 is provided to the ICBWE decoder 174.

In a particular implementation, the high-band residual prediction unit 168 includes the all-pass decorrelation filters and a gain mapper. The all-pass decorrelation filters generate a filtered signal (e.g., a time-domain signal) by filtering the decoded high-band mid signal 224. The gain mapper generates the high-band residual prediction signal 226 by performing a gain-mapping operation on the filtered signal.

In a particular implementation, the high-band residual prediction unit 168 generates the high-band residual prediction signal 226 by performing a spectral mapping operation, a filtering operation, or both. For example, the high-band residual prediction unit 168 generates a spectrally-mapped signal by performing a spectral mapping operation on the decoded high-band mid signal 224 and generates the high-band residual prediction signal 226 by filtering the spectrally-mapped signal.

The ICBWE decoder 174 may be configured to generate a high-band left channel 228 and a high-band right channel 230 based on the decoded high-band mid signal 224, the high-band residual prediction signal 226, and the parameters 184 (e.g., ICBWE parameters). Operations of the ICBWE decoder 174 are described with respect to FIG. 3.

Figure 3:
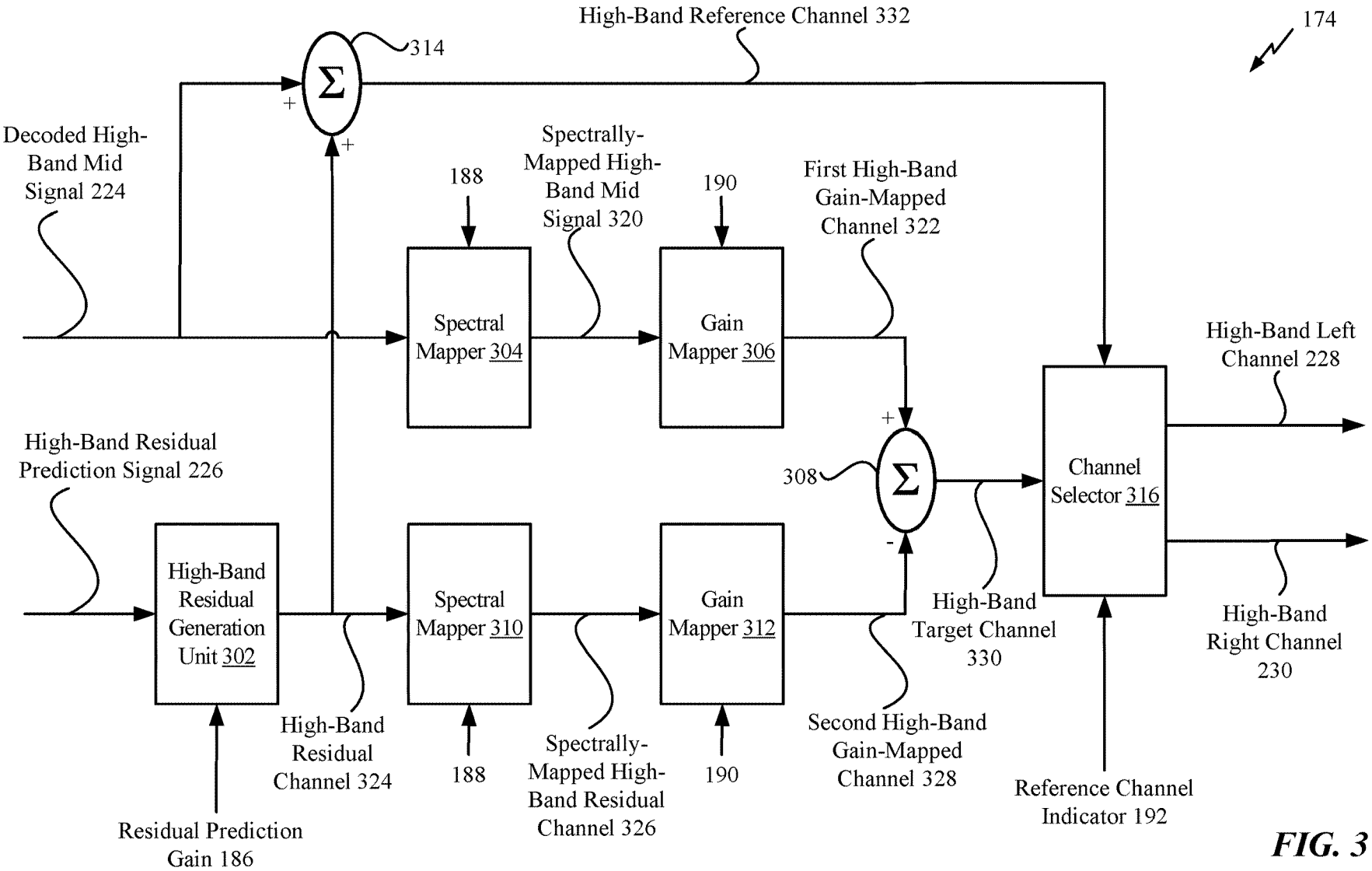
FIG. 3 is a diagram illustrating an ICBWE decoder.

Referring to FIG. 3, a particular implementation of the ICBWE decoder 174 is shown. The ICBWE decoder 174 includes a high-band residual generation unit 302, a spectral mapper 304, a gain mapper 306, a combination circuit 308, a spectral mapper 310, a gain mapper 312, a combination circuit 314, and a channel selector 316.

The high-band residual prediction signal 226 is provided to the high-band residual generation unit 302. The residual prediction gain 186 (encoded into the bitstream 180) is also provided to the high-band residual generation unit 302. The high-band residual generation unit 302 may be configured to apply the residual prediction gain 186 to the high-band residual predication signal 226 to generate a high-band residual channel 324 (e.g., a high-band side signal). In some implementations, when there is more than one high-band residual prediction gain in different bands, these gains may be applied differently across different high-band frequencies. This may be achieved by deriving a filter from the multiple high-band residual prediction gains and filtering the high-band residual prediction signal 226 with such filter to generate the high-band residual channel 324. The high-band residual channel 324 is provided to the combination circuit 314 and to the spectral mapper 310.

According to one implementation, for a 12.8 kHz low-band core, the high-band residual prediction signal 226 (e.g., a mid high-band stereo filling signal) is processed by the high-band residual generation unit 302 using residual predication gains. For example, the high-band residual generation unit 302 may map two-band gains to a first order filter. The processing may be performed in the un-flipped domain (e.g., covering 6.4 kHz to 14.4 kHz of the 32 kHz signal). Alternatively, the processing may be performed on the spectrally flipped and down-mixed high-band channel (e.g., covering 6.4 kHz to 14.4 kHz at baseband). For a 16 kHz low-band core, a mid signal low-band nonlinear excitation is mixed with envelope-shaped noise to generate a target high-band nonlinear excitation. The target high-band nonlinear excitation is filtered using a mid signal high-band low-pass filter to generate the decoded high-band mid signal 224.

The decoded high-band mid signal 224 is provided to the combination circuit 314 and to the spectral mapper 304. The combination circuit 314 may be configured to combine the decoded high-band mid signal 224 and the high-band residual channel 324 to generate a high-band reference channel 332. In some implementations, prior to the generation of the high-band reference channel 332, the combined output of the combination circuit 314 may first be scaled with a gain factor based on 190. The high-band reference channel 332 is provided to the channel selector 316.

The spectral mapper 304 may be configured to perform a first spectral mapping operation on the decoded high-band mid signal 224 to generate a spectrally-mapped high-band mid signal 320. For example, the spectral mapper 304 may apply the spectral mapping parameters 188 (e.g., dequantized spectral mapping parameters) to the decoded high-band mid signal 224 to generate the spectrally-mapped high-band mid signal 320. The spectrally-mapped high-band mid signal 320 is provided to the gain mapper 306.

The gain mapper 306 may be configured to perform a first gain mapping operation on the spectrally-mapped high-band mid signal 320 to generate a first high-band gain-mapped channel 322. For example, the gain mapper 306 may apply the gain mapping parameters 190 to the spectrally-mapped high-band mid signal 320 to generate the first high-band gain-mapped channel 322. The first high-band gain-mapped channel 322 is provided to the combination circuit 308.

In the implementation illustrated in FIG. 3, the ICBWE decoder 174 includes the spectral mapper 304. It should be understood that in some other implementations, the ICBWE decoder 174 does not include the spectral mapper 304. In these implementations, the decoded high-band mid signal 224 is provided to the gain mapper 306 (instead of the spectral mapper 304) and the gain mapper 306 performs the first gain mapping operation on the decoded high-band mid signal 224 to generate the first high-band gain-mapped channel 322. For example, the gain mapper 306 may apply the gain mapping parameters 190 to the decoded high-band mid signal 224 to generate the first high-band gain-mapped channel 322.

The spectral mapper 310 may be configured to perform a second spectral mapping operation on the high-band residual channel 324 to generate a spectrally-mapped high-band residual channel 326. For example, the spectral mapper 310 may apply the spectral mapping parameters 188 to the high-band residual channel 324 to generate the spectrally-mapped high-band residual channel 326. The spectrally-mapped high-band residual channel 326 is provided to the gain mapper 312.

The gain mapper 312 may be configured to perform a second gain mapping operation on the spectrally-mapped high-band residual channel 326 to generate a second high-band gain-mapped channel 328. For example, the gain mapper 312 may apply the gain mapping parameters 190 to the spectrally-mapped high-band residual channel 326 to generate the second high-band gain-mapped channel 328. The second high-band gain-mapped channel 328 is provided to the combination circuit 308.

In the implementation illustrated in FIG. 3, the ICBWE decoder 174 includes the spectral mapper 310. It should be understood that in some other implementations, the ICBWE decoder 174 does not include the spectral mapper 310. In these implementations, the high-band residual channel 324 is provided to the gain mapper 312 (instead of the spectral mapper 310) and the gain mapper 312 performs the second gain mapping operation on the high-band residual channel 324 to generate the second high-band gain-mapped channel 328. For example, the gain mapper 312 may apply the gain mapping parameters 190 to the high-band residual channel 324 to generate the second high-band gain-mapped channel 328.

In other alternative implementations, instead of applying spectral mapping on the high-band residual channel 324 and the decoded high-band mid signal 224 independently, the combiner 308 may combine the channels 324, 224, the spectral mapper 304 may perform a spectral mapping operation on the combined channels, and the gain mapper 306 may perform gain mapping on the resulting channel to generate the high-band target channel 330. In another alternate implementation, the spectral mapping operations on the high-band residual channel 324 and the decoded high-band mid signal 224 may be performed independently, the combiner 308 may combine the resulting channels, and the gain mapper 306 may apply a gain to generate the high-band target channel 330.

The combination circuit 308 may be configured to combine the first high-band gain-mapped channel 322 and the second high-band gain-mapped channel 328 to generate a high-band target channel 330. The high-band target channel 330 is provided to the channel selector 316.

The channel selector 316 may be configured to designate one of the high-band reference channel 332 or the high-band target channel 330 as the high-band left channel 228. The channel selector 316 may also be configured to designate the other of the high-band reference channel 332 or the high-band target channel 330 as the high-band right channel 230. For example, the reference channel indicator 192 is provided to the channel selector 316. If the reference channel indicator 192 has a binary value of "0", the channel selector 316 designates the high-band reference channel 332 as the high-band left channel 228 and designates the high-band target channel 330 as the high-band right channel 230. If the reference channel indicator 192 has a binary value of "1", the channel selector 316 designates the high-band reference channel 332 as the high-band right channel 230 and designates the high-band target channel 330 as the high-band left channel 228.

Referring back to FIG. 2, the high-band left channel 228 is provided to the combination circuit 206, and the high-band right channel 230 is provided to the combination circuit 208. The combination circuit 206 may be configured to combine the low-band left channel 220 and the high-band left channel 228 to generate the left channel 126, and the combination circuit 208 may be configured to combine the low-band right channel 222 and the high-band right channel 230 to generate the right channel 128.

The techniques described with respect to FIGS. 1-3 may reduce computational complexity by bypassing resampling operations of the decoded low-band mid signal 212. For example, instead of resampling the decoded low-band mid signal 212 at 32 kHz, combining the resampled signal to the decoded high-band mid signal 224, and determining a residual prediction signal (e.g., a stereo filling channel or side signal) based on the combined signal, the residual prediction of the decoded low-band mid signal 212 may be determined separately. As a result, computation complexity associated with resampling the decoded low-band mid signal 212 is reduced and the DFT analysis of the low-band residual prediction signal 214 may be performed at 16 kHz (as opposed to 32 kHz).

Figure 4:
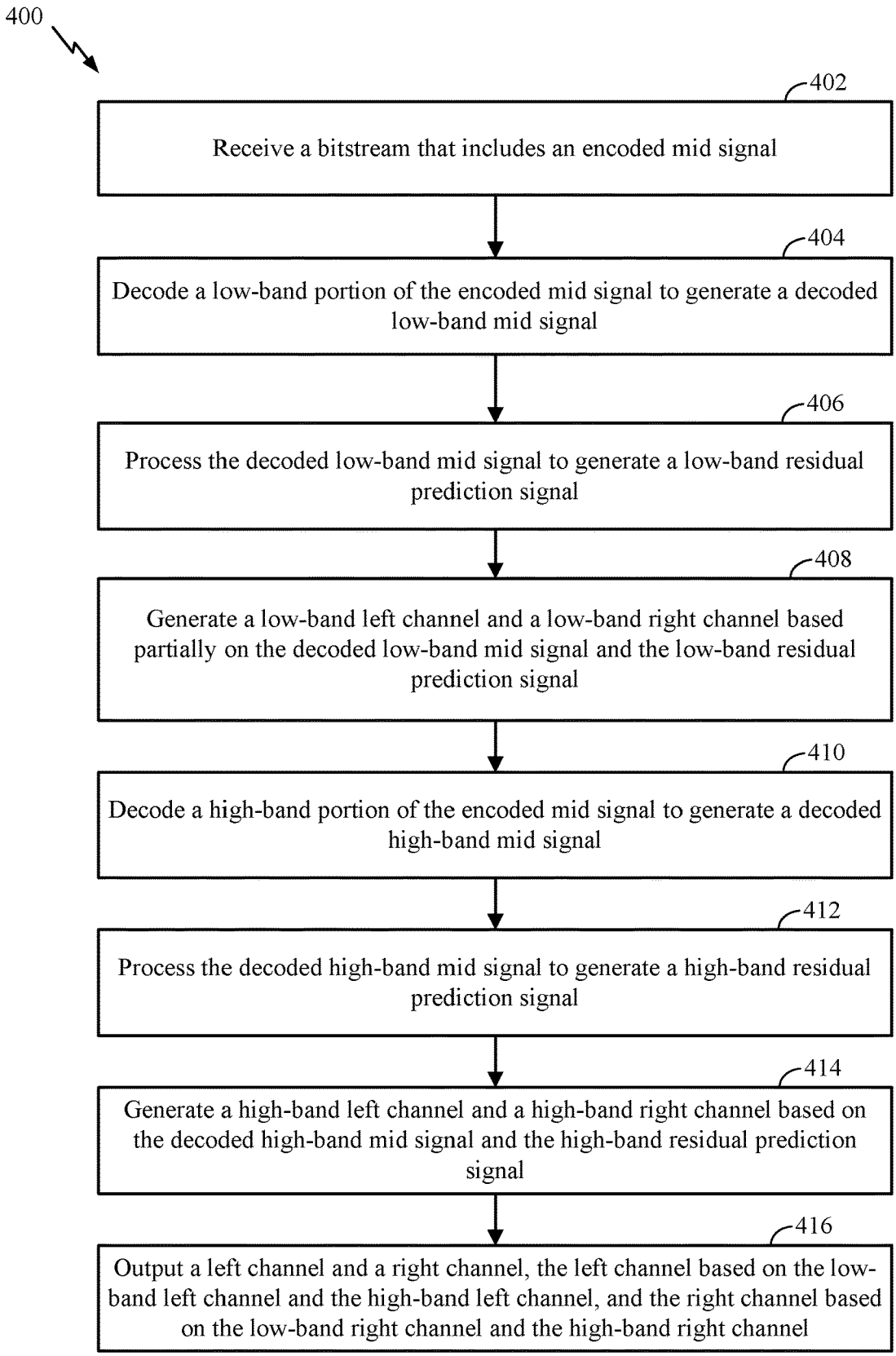
FIG. 4 is a particular example of a method of predicting a high-band residual channel.

Referring to FIG. 4, a method 400 of processing an encoded bitstream is shown. The method 400 may be performed by the second device 106 of FIG. 1. More specifically, the method 400 may be performed by the receiver 160 and the decoder 162.

The method 400 includes receiving, at a decoder, a bitstream that includes an encoder mid signal, at 402. For example, referring to FIG. 1, the receiver 160 may receive the bitstream 180 from the first device 104. The bitstream 180 includes the encoded mid signal 182 and the parameters 184.

The method 400 also includes decoding a low-band portion of the encoded mid signal to generate a decoded low-band mid signal, at 404. For example, referring to FIG. 2, the low-band mid signal decoder may decode the low-band portion of the encoded mid signal 182 to generate the decoded low-band mid signal 212. The method 400 also includes processing the decoded low-band mid signal to generate a low-band residual prediction signal, at 406. For example, referring to FIG. 2, the low-band residual prediction unit 170 may process the decoded low-band mid signal 212 to generate the low-band residual prediction signal 214.

The method 400 also includes generating a low-band left channel and a low-band right channel based partially on the decoded low-band mid signal and the low-band residual prediction signal, at 408. For example, referring to FIG. 2, the transform unit 202 may perform a first transform operation on the low-band residual prediction signal 214 to generate the frequency-domain low-band residual prediction signal 216. The transform unit 204 may perform a second transform operation on the decoded low-band mid signal 212 to generate the frequency-domain low-band mid signal 218. The up-mix processor 172 may receive the parameters 184 (including the reference channel indicator 192 and the residual prediction gain 186), and the up-mix processor 172 may perform an up-mix operation to generate the low-band left channel 220 and the low-band right channel 222 based on the parameters 184, the frequency-domain low-band mid signal 218, and the frequency-domain low-band residual prediction signal 216.

The method 400 also includes decoding a high-band portion of the encoded mid signal to generate a decoded high-band mid signal, at 410. For example, referring to FIG. 2, the high-band mid signal decoder 164 may decode the high-band portion of the encoded mid signal 182 to generate the decoded high-band mid signal 224. The method 400 also includes processing the decoded high-band mid signal to generate a high-band residual prediction signal, at 412. For example, referring to FIG. 2, the high-band residual prediction unit 168 may process the decoded high-band mid signal 224 to generate the high-band residual prediction signal 226. In another implementation, the high-band residual prediction signal 226 may be estimated from the low-band residual prediction signal 214. For example, the high-band residual prediction signal 226 may be estimated based on a non-linear harmonic bandwidth extension of the low-band residual prediction signal 214. In an alternate implementation, the high-band residual prediction signal 226 may be based on temporally and spectrally shaped noise. The temporally and spectrally shaped noise may be based on low-band parameters and high-band parameters.

The method 400 also includes generating a high-band left channel and a high-band right channel based on the decoded high-band mid signal and the high-band residual prediction signal, at 414. For example, referring to FIGS. 2-3, the ICBWE decoder 174 may generate the high-band left channel 228 and the high-band right channel 230 based on the decoded high-band mid signal 224 and the high-band residual prediction signal 226. To illustrate, the high-band residual generation unit 302 applies the residual prediction gain 186 to the high-band residual prediction signal 226 to generate the high-band residual channel 324. The combination circuit 314 combines the decoded high-band mid signal 224 and the high-band residual channel 324 to generate the high-band reference channel 332.

Additionally, the spectral mapper 304 performs the first spectral mapping operation on the decoded high-band mid signal 224 to generate the spectrally-mapped high-band mid signal 320. The gain mapper 306 performs the first gain mapping operation on the spectrally-mapped high-band mid signal 320 to generate the first high-band gain-mapped channel 322. The spectral mapper 310 performs the second spectral mapping operation on the high-band residual channel 324 to generate the spectrally-mapped high-band residual channel 326. The gain mapper 312 performs the second gain mapping operation on the spectrally-mapped high-band residual channel 326 to generate the second high-band gain-mapped channel 328. The first high-band gain-mapped channel 322 and the second high-band gain-mapped channel 328 are combined to generate the high-band target channel 330. Based on the reference channel indicator 192, one the channels 330, 332 is designated as the high-band left channel 228 and the other of the channels 330, 332 is designated as the high-band right channel 230.

The method 400 also includes outputting a left channel and a right channel, at 416. The left channel may be based on the low-band left channel and the high-band left channel, and the right channel may be based on the low-band right channel and the high-band right channel. For example, referring to FIG. 2, the combination circuit 206 may combine the low-band left channel 220 and the high-band left channel 228 to generate the left channel 126, and the combination circuit 208 may combine the low-band right channel 222 and the high-band right channel 230 to generate the right channel 128. The loudspeakers 142, 144 of FIG. 1 may output the channels 126, 128, respectively.

The method 400 of FIG. 4 may reduce computational complexity by bypassing or omitting resampling operations of the decoded low-band mid signal 212. For example, instead of resampling the decoded low-band mid signal 212 at 32 kHz, combining the resampled signal to the decoded high-band mid signal 224, and determining a residual prediction signal (e.g., a stereo filling channel or side signal) based on the combined signal, the residual prediction of the decoded low-band mid signal 212 may be determined separately. As a result, computation complexity associated with resampling the decoded low-band mid signal 212 is reduced and the DFT analysis of the low-band residual prediction signal 214 may be performed at 16 kHz (as opposed to 32 kHz).

Figure 5:
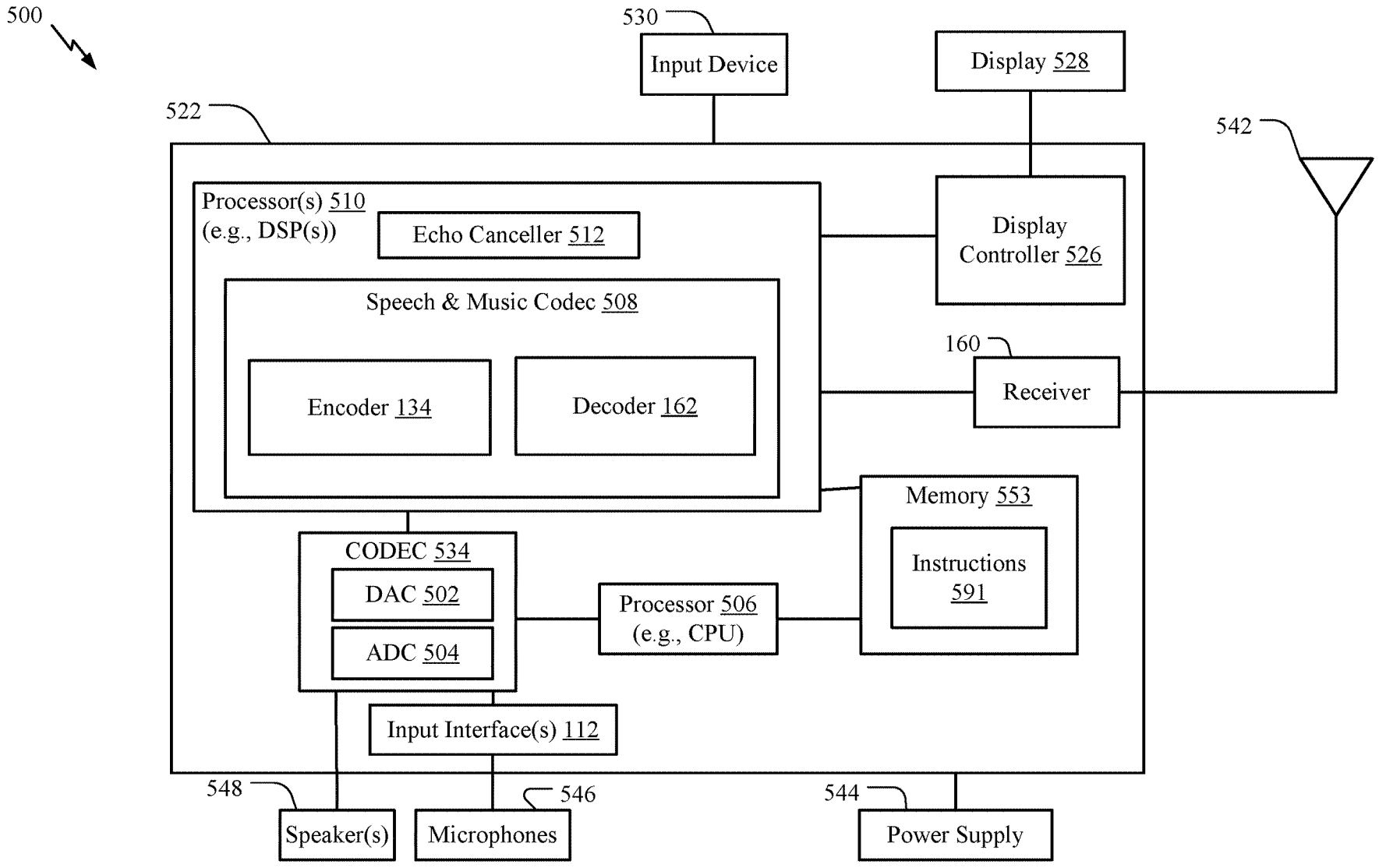
FIG. 5 is a block diagram of a particular illustrative example of a mobile device that is operable to predict a high-band residual channel and to perform time-domain ICBWE decoding operations.

Referring to FIG. 5, a block diagram of a particular illustrative example of a device (e.g., a wireless communication device) is depicted and generally designated 500. In various implementations, the device 500 may have fewer or more components than illustrated in FIG. 5. In an illustrative implementation, the device 500 may correspond to the first device 104 of FIG. 1 or the second device 106 of FIG. 1. In an illustrative implementation, the device 500 may perform one or more operations described with reference to systems and methods of FIGS. 1-4.

In a particular implementation, the device 500 includes a processor 506 (e.g., a central processing unit (CPU)). The device 500 may include one or more additional processors 510 (e.g., one or more digital signal processors (DSPs)). The processors 510 may include a media (e.g., speech and music) coder-decoder (CODEC) 508, and an echo canceller 512. The media CODEC 508 may include the decoder 162, the encoder 134, or a combination thereof.

The device 500 may include a memory 553 and a CODEC 534. Although the media CODEC 508 is illustrated as a component of the processors 510 (e.g., dedicated circuitry and/or executable programming code), in other implementations one or more components of the media CODEC 508, such as the decoder 162, the encoder 134, or a combination thereof, may be included in the processor 506, the CODEC 534, another processing component, or a combination thereof.

The device 500 may include the receiver 160 coupled to an antenna 542. The device 500 may include a display 528 coupled to a display controller 526. One or more speakers 548 may be coupled to the CODEC 534. One or more microphones 546 may be coupled, via the input interface(s) 112, to the CODEC 534. In a particular implementation, the speakers 548 may include the first loudspeaker 142, the second loudspeaker 144 of FIG. 1, or a combination thereof. In a particular implementation, the microphones 546 may include the first microphone 146, the second microphone 148 of FIG. 1, or a combination thereof. The CODEC 534 may include a digital-to-analog converter (DAC) 502 and an analog-to-digital converter (ADC) 504.

The memory 553 may include instructions 591 executable by the processor 506, the processors 510, the CODEC 534, another processing unit of the device 500, or a combination thereof, to perform one or more operations described with reference to FIGS. 1-4.

One or more components of the device 500 may be implemented via dedicated hardware (e.g., circuitry), by a processor executing instructions to perform one or more tasks, or a combination thereof. As an example, the memory 553 or one or more components of the processor 506, the processors 510, and/or the CODEC 534 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 591) that, when executed by a computer (e.g., a processor in the CODEC 534, the processor 506, and/or the processors 510), may cause the computer to perform one or more operations described with reference to FIGS. 1-4. As an example, the memory 553 or the one or more components of the processor 506, the processors 510, and/or the CODEC 534 may be a non-transitory computer-readable medium that includes instructions (e.g., the instructions 591) that, when executed by a computer (e.g., a processor in the CODEC 534, the processor 506, and/or the processors 510), cause the computer perform one or more operations described with reference to FIGS. 1-4.

In a particular implementation, the device 500 may be included in a system-in-package or system-on-chip device (e.g., a mobile station modem (MSM)) 522. In a particular implementation, the processor 506, the processors 510, the display controller 526, the memory 553, the CODEC 534, and the receiver 160 are included in a system-in-package or the system-on-chip device 522. In a particular implementation, an input device 530, such as a touchscreen and/or keypad, and a power supply 544 are coupled to the system-on-chip device 522. Moreover, in a particular implementation, as illustrated in FIG. 5, the display 528, the input device 530, the speakers 548, the microphones 546, the antenna 542, and the power supply 544 are external to the system-on-chip device 522. However, each of the display 528, the input device 530, the speakers 548, the microphones 546, the antenna 542, and the power supply 544 can be coupled to a component of the system-on-chip device 522, such as an interface or a controller.

The device 500 may include a wireless telephone, a mobile communication device, a mobile phone, a smart phone, a cellular phone, a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, a decoder system, an encoder system, or any combination thereof.

Figure 6:
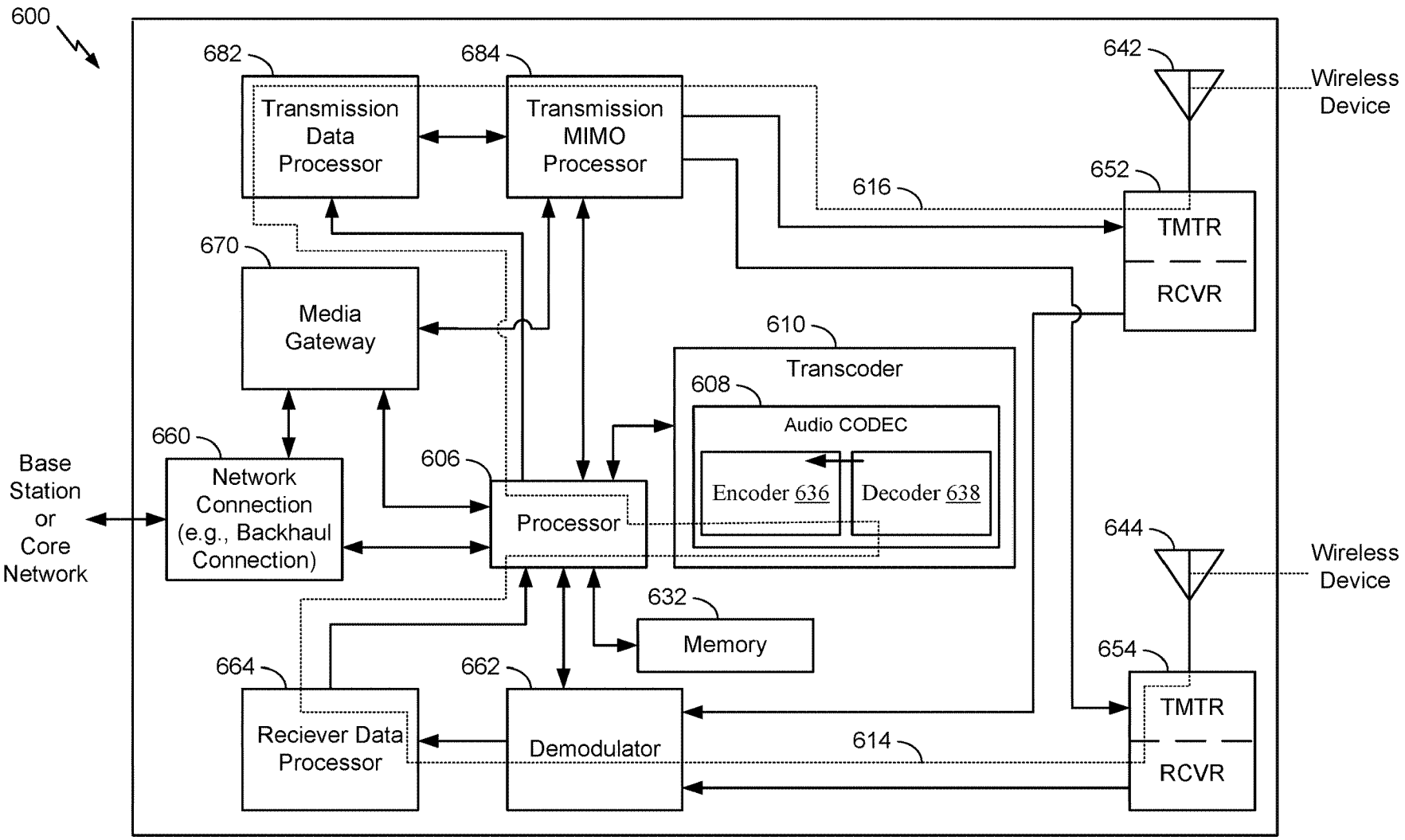
FIG. 6 is a block diagram of a base station that is operable to predict a high-band residual channel and to perform time-domain ICBWE decoding operations.

Referring to FIG. 6, a block diagram of a particular illustrative example of a base station 600 is depicted. In various implementations, the base station 600 may have more components or fewer components than illustrated in FIG. 6. In an illustrative example, the base station 600 may include the first device 104 or the second device 106 of FIG. 1. In an illustrative example, the base station 600 may operate according to one or more of the methods or systems described with reference to FIGS. 1-4.

The base station 600 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1×, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 600 of FIG. 6.

Various functions may be performed by one or more components of the base station 600 (and/or in other components not shown), such as sending and receiving messages and data (e.g., audio data). In a particular example, the base station 600 includes a processor 606 (e.g., a CPU). The base station 600 may include a transcoder 610. The transcoder 610 may include an audio CODEC 608. For example, the transcoder 610 may include one or more components (e.g., circuitry) configured to perform operations of the audio CODEC 608. As another example, the transcoder 610 may be configured to execute one or more computer-readable instructions to perform the operations of the audio CODEC 608. Although the audio CODEC 608 is illustrated as a component of the transcoder 610, in other examples one or more components of the audio CODEC 608 may be included in the processor 606, another processing component, or a combination thereof. For example, a decoder 638 (e.g., a vocoder decoder) may be included in a receiver data processor 664. As another example, an encoder 636 (e.g., a vocoder encoder) may be included in a transmission data processor 682.

The transcoder 610 may function to transcode messages and data between two or more networks. The transcoder 610 may be configured to convert message and audio data from a first format (e.g., a digital format) to a second format. To illustrate, the decoder 638 may decode encoded signals having a first format and the encoder 636 may encode the decoded signals into encoded signals having a second format. Additionally or alternatively, the transcoder 610 may be configured to perform data rate adaptation. For example, the transcoder 610 may down-convert a data rate or up-convert the data rate without changing a format the audio data. To illustrate, the transcoder 610 may down-convert 64 kbit/s signals into 16 kbit/s signals.

The audio CODEC 608 may include the encoder 636 and the decoder 638. The encoder 636 may include the encoder 134 of FIG. 1. The decoder 638 may include the decoder 162 of FIG. 1.

The base station 600 may include a memory 632. The memory 632, such as a computer-readable storage device, may include instructions. The instructions may include one or more instructions that are executable by the processor 606, the transcoder 610, or a combination thereof, to perform one or more operations described with reference to the methods and systems of FIGS. 1-4. The base station 600 may include multiple transmitters and receivers (e.g., transceivers), such as a first transceiver 652 and a second transceiver 654, coupled to an array of antennas. The array of antennas may include a first antenna 642 and a second antenna 644. The array of antennas may be configured to wirelessly communicate with one or more wireless devices, such as the device 600 of FIG. 6. For example, the second antenna 644 may receive a data stream 614 (e.g., a bitstream) from a wireless device. The data stream 614 may include messages, data (e.g., encoded speech data), or a combination thereof.

The base station 600 may include a network connection 660, such as backhaul connection. The network connection 660 may be configured to communicate with a core network or one or more base stations of the wireless communication network. For example, the base station 600 may receive a second data stream (e.g., messages or audio data) from a core network via the network connection 660. The base station 600 may process the second data stream to generate messages or audio data and provide the messages or the audio data to one or more wireless device via one or more antennas of the array of antennas or to another base station via the network connection 660. In a particular implementation, the network connection 660 may be a wide area network (WAN) connection, as an illustrative, non-limiting example. In some implementations, the core network may include or correspond to a Public Switched Telephone Network (PSTN), a packet backbone network, or both.

The base station 600 may include a media gateway 670 that is coupled to the network connection 660 and the processor 606. The media gateway 670 may be configured to convert between media streams of different telecommunications technologies. For example, the media gateway 670 may convert between different transmission protocols, different coding schemes, or both. To illustrate, the media gateway 670 may convert from PCM signals to Real-Time Transport Protocol (RTP) signals, as an illustrative, non-limiting example. The media gateway 670 may convert data between packet switched networks (e.g., a Voice Over Internet Protocol (VoIP) network, an IP Multimedia Subsystem (IMS), a fourth generation (4G) wireless network, such as LTE, WiMax, and UMB, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 670 may include a transcode and may be configured to transcode data when codecs are incompatible. For example, the media gateway 670 may transcode between an Adaptive Multi-Rate (AMR) codec and a G.711 codec, as an illustrative, non-limiting example. The media gateway 670 may include a router and a plurality of physical interfaces. In some implementations, the media gateway 670 may also include a controller (not shown). In a particular implementation, the media gateway controller may be external to the media gateway 670, external to the base station 600, or both. The media gateway controller may control and coordinate operations of multiple media gateways. The media gateway 670 may receive control signals from the media gateway controller and may function to bridge between different transmission technologies and may add service to end-user capabilities and connections.

The base station 600 may include a demodulator 662 that is coupled to the transceivers 652, 654, the receiver data processor 664, and the processor 606, and the receiver data processor 664 may be coupled to the processor 606. The demodulator 662 may be configured to demodulate modulated signals received from the transceivers 652, 654 and to provide demodulated data to the receiver data processor 664. The receiver data processor 664 may be configured to extract a message or audio data from the demodulated data and send the message or the audio data to the processor 606.

The base station 600 may include a transmission data processor 682 and a transmission multiple input-multiple output (MIMO) processor 684. The transmission data processor 682 may be coupled to the processor 606 and the transmission MIMO processor 684. The transmission MIMO processor 684 may be coupled to the transceivers 652, 654 and the processor 606. In some implementations, the transmission MIMO processor 684 may be coupled to the media gateway 670. The transmission data processor 682 may be configured to receive the messages or the audio data from the processor 606 and to code the messages or the audio data based on a coding scheme, such as CDMA or orthogonal frequency-division multiplexing (OFDM), as an illustrative, non-limiting examples. The transmission data processor 682 may provide the coded data to the transmission MIMO processor 684.

The coded data may be multiplexed with other data, such as pilot data, using CDMA or OFDM techniques to generate multiplexed data. The multiplexed data may then be modulated (i.e., symbol mapped) by the transmission data processor 682 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 606.

The transmission MIMO processor 684 may be configured to receive the modulation symbols from the transmission data processor 682 and may further process the modulation symbols and may perform beamforming on the data. For example, the transmission MIMO processor 684 may apply beamforming weights to the modulation symbols. The beamforming weights may correspond to one or more antennas of the array of antennas from which the modulation symbols are transmitted.

During operation, the second antenna 644 of the base station 600 may receive a data stream 614. The second transceiver 654 may receive the data stream 614 from the second antenna 644 and may provide the data stream 614 to the demodulator 662. The demodulator 662 may demodulate modulated signals of the data stream 614 and provide demodulated data to the receiver data processor 664. The receiver data processor 664 may extract audio data from the demodulated data and provide the extracted audio data to the processor 606.

The processor 606 may provide the audio data to the transcoder 610 for transcoding. The decoder 638 of the transcoder 610 may decode the audio data from a first format into decoded audio data and the encoder 636 may encode the decoded audio data into a second format. In some implementations, the encoder 636 may encode the audio data using a higher data rate (e.g., up-convert) or a lower data rate (e.g., down-convert) than received from the wireless device. In other implementations, the audio data may not be transcoded. Although transcoding (e.g., decoding and encoding) is illustrated as being performed by a transcoder 610, the transcoding operations (e.g., decoding and encoding) may be performed by multiple components of the base station 600. For example, decoding may be performed by the receiver data processor 664 and encoding may be performed by the transmission data processor 682. In other implementations, the processor 606 may provide the audio data to the media gateway 670 for conversion to another transmission protocol, coding scheme, or both. The media gateway 670 may provide the converted data to another base station or core network via the network connection 660.

Encoded audio data generated at the encoder 636, such as transcoded data, may be provided to the transmission data processor 682 or the network connection 660 via the processor 606. The transcoded audio data from the transcoder 610 may be provided to the transmission data processor 682 for coding according to a modulation scheme, such as OFDM, to generate the modulation symbols. The transmission data processor 682 may provide the modulation symbols to the transmission MIMO processor 684 for further processing and beamforming. The transmission MIMO processor 684 may apply beamforming weights and may provide the modulation symbols to one or more antennas of the array of antennas, such as the first antenna 642 via the first transceiver 652. Thus, the base station 600 may provide a transcoded data stream 616, that corresponds to the data stream 614 received from the wireless device, to another wireless device. The transcoded data stream 616 may have a different encoding format, data rate, or both, than the data stream 614. In other implementations, the transcoded data stream 616 may be provided to the network connection 660 for transmission to another base station or a core network.

In a particular implementation, one or more components of the systems and devices disclosed herein may be integrated into a decoding system or apparatus (e.g., an electronic device, a CODEC, or a processor therein), into an encoding system or apparatus, or both. In other implementations, one or more components of the systems and devices disclosed herein may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

In conjunction with the described techniques, an apparatus includes means for receiving an encoded mid signal. For example, the means for receiving the encoded mid signal may include the receiver 160 of FIGS. 1 and 5, the decoder 162 of FIGS. 1, 2, and 5, the decoder 638 of FIG. 6, one or more other devices, circuits, modules, or any combination thereof.

The apparatus also includes means for decoding a low-band portion of the encoded mid signal to generate a decoded low-band mid signal. For example, the means for decoding may include the decoder 162 of FIGS. 1, 2, and 5, the low-band mid signal decoder 166 of FIGS. 1-2, the CODEC 508 of FIG. 5, the processor 506 of FIG. 5, the instructions 591 executable by a processor, the decoder 638 of FIG. 6, one or more other devices, circuits, modules, or any combination thereof.

The apparatus also includes means for processing the decoded low-band mid signal to generate a low-band residual prediction signal. For example, the means for processing may include the decoder 162 of FIGS. 1, 2, and 5, the low-band residual prediction unit 170 of FIGS. 1-2, the CODEC 508 of FIG. 5, the processor 506 of FIG. 5, the instructions 591 executable by a processor, the decoder 638 of FIG. 6, one or more other devices, circuits, modules, or any combination thereof.

The apparatus also includes means for generating a low-band left channel and a low-band right channel based partially on the decoded low-band mid signal and the low-band residual prediction signal. For example, the means for generating may include the decoder 162 of FIGS. 1, 2, and 5, the up-mix processor 172 of FIGS. 1-2, the CODEC 508 of FIG. 5, the processor 506 of FIG. 5, the instructions 591 executable by a processor, the decoder 638 of FIG. 6, one or more other devices, circuits, modules, or any combination thereof.

The apparatus also includes means for decoding a high-band portion of the encoded mid signal to generate a decoded high-band mid signal. For example, the means for decoding may include the decoder 162 of FIGS. 1, 2, and 5, the high-band mid signal decoder 164 of FIGS. 1-2, the CODEC 508 of FIG. 5, the processor 506 of FIG. 5, the instructions 591 executable by a processor, the decoder 638 of FIG. 6, one or more other devices, circuits, modules, or any combination thereof.

The apparatus also includes means for processing the decoded high-band mid signal to generate a high-band residual prediction signal. For example, the means for processing may include the decoder 162 of FIGS. 1, 2, and 5, the high-band residual prediction unit 168 of FIGS. 1-2, the CODEC 508 of FIG. 5, the processor 506 of FIG. 5, the instructions 591 executable by a processor, the decoder 638 of FIG. 6, one or more other devices, circuits, modules, or any combination thereof.

The apparatus also includes means for generating a high-band left channel and a high-band right channel based on the decoded high-band mid signal and the high-band residual prediction signal. For example, the means for generating may include the decoder 162 of FIGS. 1, 2, and 5, the ICBWE decoder 174 of FIGS. 1-3, the high-band residual generation unit 302 of FIG. 3, the spectral mapper 304 of FIG. 3, the spectral mapper 310 of FIG. 3, the gain mapper 306 of FIG. 3, the gain mapper 312 of FIG. 3, the combination circuits 308, 314 of FIG. 3, the channel selector 316 of FIG. 3, the CODEC 508 of FIG. 5, the processor 506 of FIG. 5, the instructions 591 executable by a processor, the decoder 638 of FIG. 6, one or more other devices, circuits, modules, or any combination thereof.

The apparatus also includes means for outputting a left channel and a right channel. The left channel may be based on the low-band left channel and the thigh-band left channel, and the right channel may be based on the low-band right channel and the high-band right channel. For example, the means for outputting may include the loudspeakers 142, 144 of FIG. 1, the speakers 548 of FIG. 5, one or more other devices, circuits, modules, or any combination thereof.

It should be noted that various functions performed by the one or more components of the systems and devices disclosed herein are described as being performed by certain components or modules. This division of components and modules is for illustration only. In an alternate implementation, a function performed by a particular component or module may be divided amongst multiple components or modules. Moreover, in an alternate implementation, two or more components or modules may be integrated into a single component or module. Each component or module may be implemented using hardware (e.g., a field-programmable gate array (FPGA) device, an application-specific integrated circuit (ASIC), a DSP, a controller, etc.), software (e.g., instructions executable by a processor), or any combination thereof.

Those of skill would further appreciate that the various illustrative logical blocks, configurations, modules, circuits, and algorithm steps described in connection with the implementations disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the implementations disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A device comprising a decoder configured to receive, via a receiver, a bitstream that includes at least an encoded mid signal, the decoder including:

a high-band residual prediction unit configured to process a time-domain decoded high-band mid signal to generate a time-domain high-band residual prediction signal, the time-domain decoded high-band mid signal based on the encoded mid signal; and an inter-channel bandwidth extension decoder configured to generate a high-band left channel and a high-band right channel based on the time-domain decoded high-band mid signal and the time-domain high-band residual prediction signal.

2. The device of claim 1, wherein the high-band residual prediction unit comprises:

one or more all-pass filters configured to generate a filtered time-domain signal by filtering the time-domain decoded high-band mid signal; and a gain mapper configured to generate the time-domain high-band residual prediction signal by performing a gain mapping operation on the filtered time-domain signal.

3. The device of claim 1, wherein the high-band residual prediction unit is further configured to:

generate a spectrally-mapped signal by performing a spectral mapping operation on the time-domain decoded high-band mid signal; and generate the time-domain high-band residual prediction signal by filtering the spectrally-mapped signal.

4. The device of claim 1, further comprising:

a low-band mid signal decoder configured to decode a low-band portion of the encoded mid signal to generate a decoded low-band mid signal;

a low-band residual prediction unit configured to process the decoded low-band mid signal to generate a low-band residual prediction signal;

an up-mix processor configured to generate a low-band left channel and a low-band right channel based partially on the decoded low-band mid signal and the low-band residual prediction signal; and a high-band mid signal decoder configured to decode a high-band portion of the encoded mid signal to generate the time-domain decoded high-band mid signal.

5. The device of claim 4, comprising the receiver, wherein the bitstream further includes one or more parameters and a reference channel indicator, the one or more parameters comprising a residual prediction gain, wherein the up-mix processor is further configured to generate the low-band left channel and the low-band right channel at least partially based on the one or more parameters and the reference channel indicator.

6. The device of claim 4, further comprising:

a first combination circuit configured to combine the low-band left channel and the high-band left channel to generate a left channel;

a second combination circuit configured to combine the low-band right channel and the high-band right channel to generate a right channel; and an output device configured to output the left channel and the right channel.

7. The device of claim 6, wherein the inter-channel bandwidth extension decoder comprises:

a high-band residual generation unit configured to apply a residual prediction gain to the time-domain high-band residual prediction signal to generate a high-band residual channel; and a third combination circuit configured to combine the time-domain decoded high-band mid signal and the high-band residual channel to generate a high-band reference channel.

8. The device of claim 7, wherein the inter-channel bandwidth extension decoder further comprises:

a first spectral mapper configured to perform a first spectral mapping operation on the time-domain decoded high-band mid signal to generate a spectrally-mapped high-band mid signal; and a second spectral mapper configured to perform a second spectral mapping operation on the high-band residual channel to generate a spectrally-mapped high-band residual channel.

9. The device of claim 7, wherein the inter-channel bandwidth extension decoder further comprises a first gain mapper configured to perform a first gain mapping operation on the time-domain decoded high-band mid signal to generate a first high-band gain-mapped channel.

10. The device of claim 9, wherein the inter-channel bandwidth extension decoder further comprises a second gain mapper configured to perform a second gain mapping operation on the high-band residual channel to generate a second high-band gain-mapped channel.

11. The device of claim 10, wherein the inter-channel bandwidth extension decoder further comprises:

a fourth combination circuit configured to combine the first high-band gain-mapped channel and the second high-band gain-mapped channel to generate a high-band target channel; and a channel selector configured to:

receive a reference channel indicator; and based on the reference channel indicator:

designate one of the high-band reference channel or the high-band target channel as the high-band left channel; and designate the other of the high-band reference channel or the high-band target channel as the high-band right channel.

12. The device of claim 1, wherein the high-band residual prediction unit comprises a gain mapper configured to generate the time-domain high-band residual prediction signal by performing a gain mapping operation on a second time-domain signal, the second time-domain signal based on the time-domain decoded high-band mid signal.

13. The device of claim 1, wherein the high-band residual prediction unit and the inter-channel bandwidth extension decoder are integrated into a base station or a mobile device.

14. A method comprising:

receiving, at a decoder, a bitstream that includes at least an encoded mid signal;

processing, at the decoder, a time-domain decoded high-band mid signal to generate a time-domain high-band residual prediction signal, the time-domain decoded high-band mid signal based on the encoded mid signal; and generating, at the decoder, a high-band left channel and a high-band right channel based on the time-domain decoded high-band mid signal and the time-domain high-band residual prediction signal.

15. The method of claim 14, further comprising:

decoding, at the decoder, a low-band portion of the encoded mid signal to generate a decoded low-band mid signal;

processing, at the decoder, the decoded low-band mid signal to generate a low-band residual prediction signal;

generating, at the decoder, a low-band left channel and a low-band right channel based partially on the decoded low-band mid signal and the low-band residual prediction signal; and decoding, at the decoder, a high-band portion of the encoded mid signal to generate the time-domain decoded high-band mid signal.

16. The method of claim 15, further comprising:

combining, at the decoder, the low-band left channel and the high-band left channel to generate a left channel; and combining, at the decoder, the low-band right channel and the high-band right channel to generate a right channel.

17. The method of claim 15, further comprising:

performing, at the decoder, a first transform operation on the low-band residual prediction signal to generate a frequency-domain low-band residual prediction signal; and performing, at the decoder, a second transform operation on the decoded low-band mid signal to generate a frequency-domain low-band mid signal.

18. The method of claim 17, further comprising:

receiving, at the decoder, one or more parameters and a reference channel indicator, the one or more parameters comprising a residual prediction gain; and generating, at the decoder, the low-band left channel and the low-band right channel based on the one or more parameters, the reference channel indicator, the frequency-domain low-band residual prediction signal, and the frequency-domain low-band mid signal.

19. The method of claim 15, further comprising:

applying, at the decoder, a residual prediction gain to the time-domain high-band residual prediction signal to generate a high-band residual channel; and combining, at the decoder, the time-domain decoded high-band mid signal and the high-band residual channel to generate a high-band reference channel.

20. The method of claim 19, further comprising:

performing, at the decoder, a first spectral mapping operation on the time-domain decoded high-band mid signal to generate a spectrally-mapped high-band mid signal; and performing, at the decoder, a first gain mapping operation on the spectrally-mapped high-band mid signal to generate a first high-band gain-mapped channel.

21. The method of claim 20, further comprising:

performing, at the decoder, a second spectral mapping operation on the high-band residual channel to generate a spectrally-mapped high-band residual channel; and performing, at the decoder, a second gain mapping operation on the spectrally-mapped high-band residual channel to generate a second high-band gain-mapped channel.

22. The method of claim 21, further comprising:

combining, at the decoder, the first high-band gain-mapped channel and the second high-band gain-mapped channel to generate a high-band target channel;

receiving a reference channel indicator at the decoder; and based on the reference channel indicator:

designating, at the decoder, one of the high-band reference channel or the high-band target channel as the high-band left channel; and designating, at the decoder, the other of the high-band reference channel or the high-band target channel as the high-band right channel.

23. The method of claim 14, wherein processing the time-domain decoded high-band mid signal comprises scaling the time-domain decoded high-band mid signal.

24. The method of claim 14, wherein processing the time-domain decoded high-band mid signal comprises filtering the time-domain decoded high-band mid signal.

25. The method of claim 14, further comprising performing, at the decoder, a spectral mapping operation on the time-domain decoded high-band mid signal to generate a spectrally-mapped signal, the time-domain high-band residual prediction signal based on the spectrally-mapped signal.

26. The method of claim 14, wherein processing the time-domain decoded high-band mid signal is performed at a base station or a mobile device.

27. A non-transitory computer-readable medium comprising instructions that, when executed by a processor within a decoder, cause the processor to perform operations comprising:

receiving, at a decoder, a bitstream that includes at least an encoded mid signal;

processing, at the decoder, a time-domain decoded high-band mid signal to generate a time-domain high-band residual prediction signal, the time-domain decoded high-band mid signal based on the encoded mid signal; and generating, at the decoder, a high-band left channel and a high-band right channel based on the time-domain decoded high-band mid signal and the time-domain high-band residual prediction signal.

28. The non-transitory computer-readable medium of claim 27, wherein the operations further comprise:

decoding, at the decoder, a low-band portion of an encoded mid signal to generate a decoded low-band mid signal; and generating, at the decoder, a low-band left channel and a low-band right channel based partially on the decoded low-band mid signal.

29. An apparatus comprising:

means for receiving, at a decoder, a bitstream that includes at least an encoded mid signal;

means for processing, at the decoder, a time-domain decoded high-band mid signal to generate a time-domain high-band residual prediction signal, the time-domain decoded high-band mid signal based on the encoded mid signal; and means for generating, at the decoder, a high-band left channel and a high-band right channel based on the time-domain decoded high-band mid signal and the time-domain high-band residual prediction signal.

30. The apparatus of claim 29, wherein the means for processing is integrated into a base station or a mobile device.

* * * * *